US007725062B2

(12) United States Patent
Kiryu

(10) Patent No.: US 7,725,062 B2
(45) **Date of Patent: *May 25, 2010**

(54) DRIVE CONTROL UNIT, DRIVE CONTROL METHOD AND IMAGE FORMING APPARATUS

(75) Inventor: Koji Kiryu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 184 days.

This patent is subject to a terminal disclaimer.

(21) Appl. No.: 11/467,420

(22) Filed: Aug. 25, 2006

(65) Prior Publication Data

US 2007/0048017 A1 Mar. 1, 2007

(30) Foreign Application Priority Data

Aug. 29, 2005 (JP) ..... 2005-248009

(51) Int. Cl.
*G03G 15/01* (2006.01)

(52) U.S. Cl. ..... 399/301; 399/302; 347/116

(58) Field of Classification Search ..... 399/301, 399/31, 179, 299, 302; 347/116
See application file for complete search history.

(56) References Cited

U.S. PATENT DOCUMENTS

| | | | | |
|---|---|---|---|---|
| 5,995,802 | A * | 11/1999 | Mori et al. | 399/394 |
| 7,437,100 | B2 * | 10/2008 | Kiryu | 399/167 |
| 2004/0131386 | A1 * | 7/2004 | Koide | 399/167 |
| 2005/0063740 | A1 * | 3/2005 | Masubuchi | 399/299 |

FOREIGN PATENT DOCUMENTS

| | | | |
|---|---|---|---|
| EP | 0 818 917 | A2 | 1/1998 |
| EP | 0 849 813 | A1 | 6/1998 |
| JP | 9-250606 | A | 9/1997 |
| JP | 10-78734 | | 3/1998 |
| JP | 10-119355 | | 5/1998 |
| JP | 2001-339972 | A | 12/2001 |
| JP | 2002-72816 | | 3/2002 |
| JP | 2004-45862 | A | 2/2004 |

OTHER PUBLICATIONS

English Translation of Japanese Patent Application, Publication # 09-250606 Author: Kobayashi, Masakuzu Date of publication: Sep. 22, 1997.*
English translation of Nakamura, et al. (JP pub 2002-072816).*

* cited by examiner

*Primary Examiner*—David M Gray
*Assistant Examiner*—Geoffrey T Evans
(74) *Attorney, Agent, or Firm*—Oblon, Spivak, McClelland, Maier & Neustadt, L.L.P.

(57) ABSTRACT

A drive control unit for controlling speeds of driving parts based on a target speed, includes a detecting part to detect speed fluctuations of each of the driving parts when the speeds of the driving parts are controlled based on a common target speed, a storage part to store speed fluctuation profiles of each of the driving parts created based on the detected speed fluctuations, an extracting part to extract a speed fluctuation profile having a largest amplitude of the speed fluctuation profiles stores in the storage part, a calculating part to calculate difference profiles of the driving parts, corresponding to differences between the extracted speed fluctuation profile and the speed fluctuation profiles of each of the driving parts, a setting part to set the difference profiles of the driving parts as new target speeds of the driving parts, and a control part to control the speeds of the driving parts based on the new target speeds.

11 Claims, 11 Drawing Sheets

DRIVE CONTROL UNIT, DRIVE CONTROL METHOD AND IMAGE FORMING APPARATUS

BACKGROUND OF THE INVENTION

1. Field of the Invention

The present invention generally relates to drive control units, drive control methods and image forming apparatuses, and more particularly to a drive control unit and a drive control method for controlling speeds of a plurality of driving parts, and an image forming apparatus which employs such a drive control unit or drive control method.

2. Description of the Related Art

Conventionally, as methods of forming color images, there are the intermediate transfer method and the tandem method. The intermediate transfer method forms a toner image on one photoconductive drum, one color at a time, and obtains the full color image by successively transferring the toner images of different colors on a transfer member. The tandem method arranged a plurality of photoconductive drums in parallel, forms the toner image of one color at each photoconductive drum, and obtains the full color image by successively transferring the toner images of different colors on the transfer member which successively passes the plurality of photoconductive drums. According to the tandem method, it is possible to carry out a high-speed image formation by operating the plurality of photoconductive drums approximately at the same time in synchronism with each other.

Since the tandem method overlaps the toner images of the different colors, the plurality of photoconductive drums must rotate without flutter and in accurate synchronism with each other. Hence, in the tandem method which uses the plurality of photoconductive drums (for example, four photoconductive drums in order to obtain the full color image), the rotational speeds of the photoconductive drums are controlled independently so as to match the toner images of different colors that are overlapped.

The tandem method can form the full color image without registration error of each of the colors (for example, black, yellow, magenta and cyan) if the rotational speeds of the plurality of photoconductive drums are all constant. However, since the plurality of photoconductive drums are controlled independently, it is difficult to perfectly match the rotational speeds of the plurality of photoconductive drums.

In other words, in the case of the tandem method, even if a target rotational speed is set with respect to each of the plurality of photoconductive drums, each photoconductive drum undergoes a fluctuation in its rotational speed that is peculiar to each photoconductive drum, due to eccentricity of a drum shaft and mounting error of a driving part and the photoconductive drum itself. As a result, the registration error in which the overlapping toner images of the different colors do not match on the transfer member is caused by the fluctuations in the rotational speeds of the plurality of photoconductive drums.

FIG. 1 is a system block diagram showing an example of a drive control unit for the photoconductive drums. The drive control unit shown in FIG. 1 includes drive control systems for each of the colors, which are black, yellow, magenta and cyan in this particular case. The drive control system for black includes a control part 1K, a motor 2K, a photoconductive drum 3K and an encoder 4K.

The motor 2K is coupled to the photoconductive drum 3K via a driving shaft and drives the photoconductive drum 3K. The encoder 4K detects the actual rotational speed of the motor 2K. In addition, the control part 1K controls the rotational speed of the motor 2K depending on a difference between a target rotational speed which is a constant value and the actual rotational speed that is fed back from the encoder 4K.

The drive control system for yellow includes a control part 1Y, a motor 2Y, a photoconductive drum 3Y and an encoder 4Y. The drive control system for magenta includes a control part 1M, a motor 2M, a photoconductive drum 3M and an encoder 4M. The drive control system for cyan includes a control part 1C, a motor 2C, a photoconductive drum 3C and an encoder 4C. The drive control systems for yellow, magenta and cyan operate similarly to the drive control system for black described above.

However, even though the drive control unit having the structure shown in FIG. 1 controls the rotational speed of the motor 2K depending on the difference between the constant target rotational speed and the actual rotational speed that are fed back from the encoder 4K, the photoconductive drum 3K undergoes a fluctuation in its rotational speed that is peculiar to the photoconductive drum 3K, due to the eccentricity of the drum shaft and the mounting error of the driving part and the photoconductive drum 3K itself. As a result, the registration error in which the overlapping toner images of the different colors do not match on the transfer member is caused by the fluctuations in the rotational speed of the photoconductive drum 3K.

In addition, in the drive control systems for yellow, magenta and cyan, the registration error is generated similarly to the drive control system for black. In other words, the rotational speeds for one revolution of the photoconductive drums 3K, 3Y, 3M and 3C fluctuate as shown in FIG. 2. FIG. 2 is a graph showing the actual speed fluctuations for one revolution of the photoconductive drums 3K, 3Y, 3M and 3C, wherein v denotes the rotational speed in arbitrary units and t denotes the time in arbitrary units. In the following description, the fluctuation of the rotational speed for one revolution of each of the photoconductive drums 3K, 3Y, 3M and 3C will be referred to as a speed fluctuation profile.

A Japanese Laid-Open Patent Application No. 2002-72816 proposes a process of controlling the rotational speed of each photoconductive drum to approach the target rotational speed, by detecting the actual speed fluctuation profile of each photoconductive drum and adding data having an inverted phase (that is, a phase shifted by 180 degrees) with respect to the speed fluctuation profile, so as to correct the rotational speed of each photoconductive drum.

However, according to the process proposed in the Japanese Laid-Open Patent Application No. 2002-72816, the rotational speeds of the plurality of photoconductive drums are independently controlled, similarly to the conventional method. For this reason, even if the rotational speeds of the photoconductive drums are controlled to approximate the target rotational speed, it is difficult to completely eliminate the fluctuation in the rotational speeds of the photoconductive drums and to perfectly match the rotational speeds of each of the photoconductive drums.

SUMMARY OF THE INVENTION

Accordingly, it is a general object of the present invention to provide a novel and useful drive control unit, drive control method and image forming apparatus, in which the problems described above are suppressed.

Another and more specific object of the present invention is to provide a drive control unit, a drive control method and an image forming apparatus, which can reduce the registration error of the color image that is formed.

Still another object of the present invention is to provide a drive control unit for controlling speeds of a plurality of driving parts based on a target speed, comprising a detecting part configured to detect speed fluctuations of each of the driving parts when the speeds of the driving parts are controlled based on a common target speed; a storage part configured to store speed fluctuation profiles of each of the driving parts created based on the detected speed fluctuations; an extracting part configured to extract a speed fluctuation profile having a largest amplitude of the speed fluctuation profiles stores in the storage part; a calculating part configured to calculate difference profiles of the driving parts, corresponding to differences between the extracted speed fluctuation profile and the speed fluctuation profiles of each of the driving parts; a setting part configured to set the difference profiles of the driving parts as new target speeds of the driving parts; and a control part configured to control the speeds of the driving parts based on the new target speeds. According to the drive control unit of the present invention, it is possible to reduce the registration error of the color image that is formed.

A further object of the present invention is to provide a drive control method for controlling speeds of a plurality of driving parts of an image forming apparatus based on a target speed, comprising detecting speed fluctuations of each of the driving parts when the speeds of the driving parts are controlled based on a common target speed; extracting a speed fluctuation profile having a largest amplitude from speed fluctuation profiles of each of the driving parts created based on the detected speed fluctuations; calculating difference profiles of the driving parts, corresponding to differences between the extracted speed fluctuation profile and the speed fluctuation profiles of each of the driving parts; and setting the difference profiles of the driving parts as new target speeds of the driving parts, and controlling the speeds of the driving parts based on the new target speeds. According to the drive control method of the present invention, it is possible to reduce the registration error of the color image that is formed.

Another object of the present invention is to provide an image forming apparatus which forms toner images on a plurality of photoconductive drums and directly or indirectly transfers the toner images onto a recording medium to form a full color image thereon, comprising a plurality of driving parts configured to independently control rotational speeds of corresponding photoconductive drums; and a drive control unit configured to control speeds of the plurality of driving parts based on a target speed, wherein the drive control unit comprises a detecting part configured to detect speed fluctuations of each of the driving parts when the speeds of the driving parts are controlled based on a common target speed; a storage part configured to store speed fluctuation profiles of each of the driving parts created based on the detected speed fluctuations; an extracting part configured to extract a speed fluctuation profile having a largest amplitude of the speed fluctuation profiles stores in the storage part; a calculating part configured to calculate difference profiles of the driving parts, corresponding to differences between the extracted speed fluctuation profile and the speed fluctuation profiles of each of the driving parts; a setting part configured to set the difference profiles of the driving parts as new target speeds of the driving parts; and a control part configured to control the speeds of the driving parts based on the new target speeds. According to the image forming apparatus of the present invention, it is possible to reduce the registration error of the color image that is formed.

Other objects and further features of the present invention will be apparent from the following detailed description when read in conjunction with the accompanying drawings.

DESCRIPTION OF THE PREFERRED EMBODIMENTS

A description will be given of embodiments of a drive control unit, a drive control method and an image forming apparatus according to the present invention, by referring to FIG. 3 and the subsequent figures.

Figure 3:
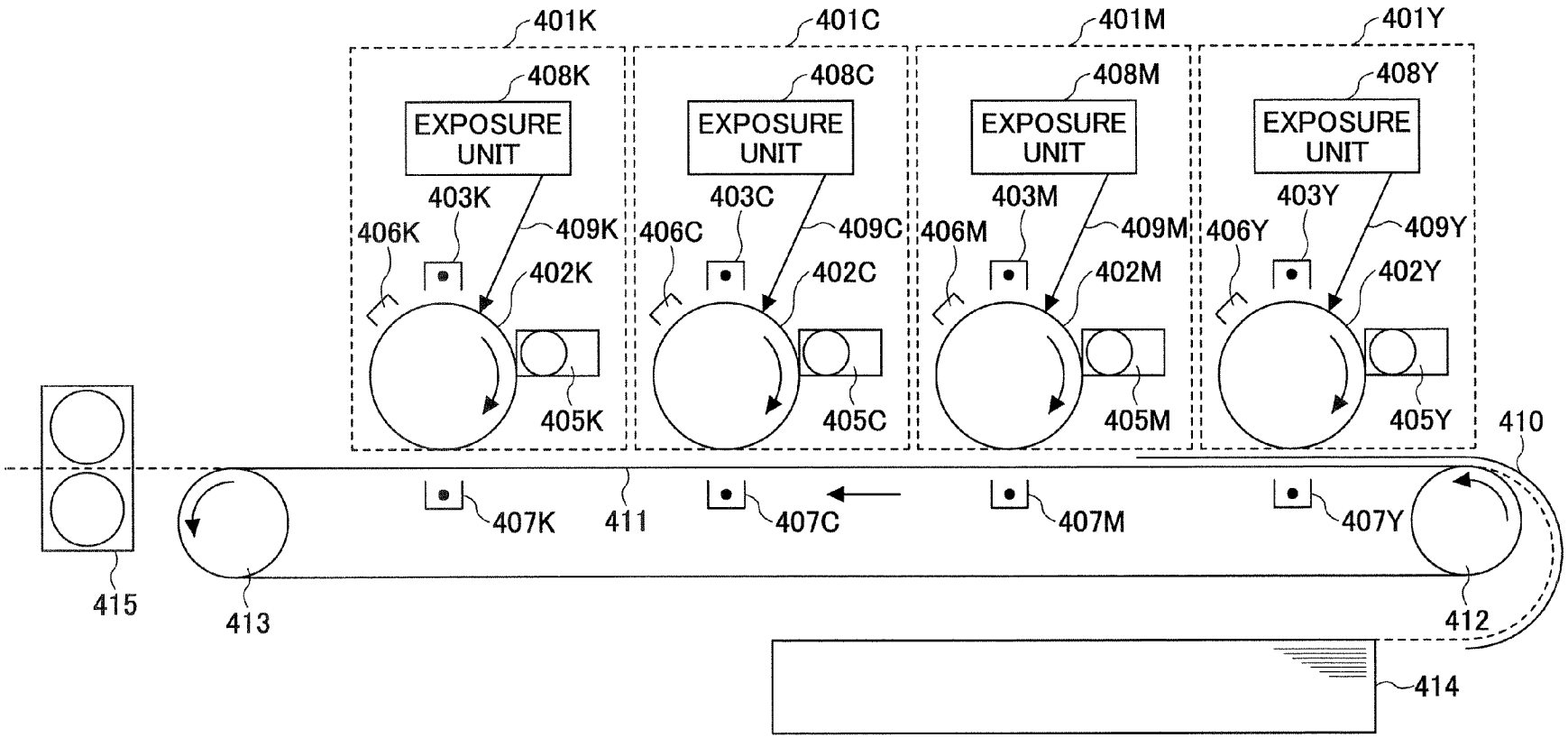
FIG. 3 is a diagram showing a general structure of an image forming apparatus.

FIG. 3 is a diagram showing a general structure of the image forming apparatus. The image forming apparatus shown in FIG. 3 has image forming parts 401Y, 401M, 401C and 401K for forming yellow, magenta, cyan and black images, respectively. The image forming parts 401Y, 401M, 401C and 401K are arranged in line along a transport belt 411 which transports a transfer member 410 which may be a sheet of paper or a suitable recording medium. The transport belt 411 is supported by a driving roller 412 which drives and revolves the transport belt 411, and a following roller 412 which follows the revolving the transport belt 411. The transport belt 411 is driven to revolve in a direction indicated by an arrow in FIG. 3 by the rotation of the driving roller 412.

A paper supply tray 414 which accommodates the transfer members 410 is provided under the transport belt 411. When forming an image, the transfer members 410 accommodated within the paper supply tray 414 are fed starting from the top transfer member 410. The fed transfer member 410 is adhered on the transport belt 411 by electrostatic adhesion, and is transported to the yellow image forming part 401Y where the yellow image is formed.

The yellow image forming part 401Y includes a photoconductive drum 402Y, a charger 403Y provided in a periphery of the photoconductive drum 402Y, a developing unit 405Y, a photoconductive body cleaner 406Y, a transfer unit 407Y, and an exposure unit 408 which irradiates laser modulated light 409Y corresponding to the yellow image.

In the yellow image forming part 401Y, the surface of the photoconductive drum 402Y is uniformly charged by the charger 403Y, and the charged surface is then exposed by the laser modulated light 409Y of the exposure unit 408, corresponding to the yellow image, so as to form an electrostatic latent image. The electrostatic latent image is developed by the developing unit 405Y, so as to form a yellow toner image on the surface of the photoconductive drum 402Y. The yellow toner image is transferred onto the transfer member 410 by the transfer unit 407Y, at a transfer position where the photoconductive drum 402Y and the transfer member 410 on the transport belt 411 make contact, to thereby form a single color image, that is, the yellow image, on the transfer member 410. After the yellow image is transferred onto the transfer member 410, the residual toner on the surface of the photoconductive drum 402Y is cleaned by the photoconductive drum cleaner 406Y, so as to prepare for the next image formation in yellow.

The transfer member 410 bearing the yellow image transferred thereon in the yellow image forming part 401Y is transported to the magenta image forming part 401M by the transport belt 411. The magenta image forming part 401M transfers a magenta toner image that is formed on the surface of the photoconductive drum 402M onto the transfer member 410, similarly to the image formation in the yellow image forming part 401Y, so as to overlap the yellow image.

The transfer member 410 is further transported to the cyan image forming part 401C and the black image forming part 401K in this sequence, so as to sequentially transfer a cyan toner image and a black toner image that are formed on the surfaces of the corresponding photoconductive drums 402C and 402K onto the transfer member 410, similarly to the image formation in the yellow image forming part 401Y, so as to overlap the yellow and magenta images. After the transfer member 410 passes the black image forming part 401K, the transfer member 410 bearing the overlapping yellow, magenta, cyan and black images, that is, a full color image, is separated from the transport belt 411 and supplied to a fixing unit 415. The fixing unit 415 fixes the full color image on the transfer member 410, and the transfer member 410 is thereafter ejected from the image forming apparatus.

The image forming apparatus shown in FIG. 3 directly transfers the toner images from the photoconductive drums 402Y, 402M, 402C and 402K onto the transfer member 410. However, it is of course possible to form the color image on an intermediate transfer body such as an intermediate transfer belt, and thereafter transfer the color image on the intermediate transfer body onto the transfer member 410 in one operation.

In the image forming apparatus, the photoconductive drums 402Y, 402M, 402C and 402K are driven by corresponding motors (not shown). The fluctuations in the rotational speeds of the photoconductive drums 402Y, 402M, 402C and 402K, peculiar to the photoconductive drums 402Y, 402M, 402C and 402K, are eliminated by drive control systems for each of the colors yellow, magenta, cyan and black, as will be described later.

Figure 4:
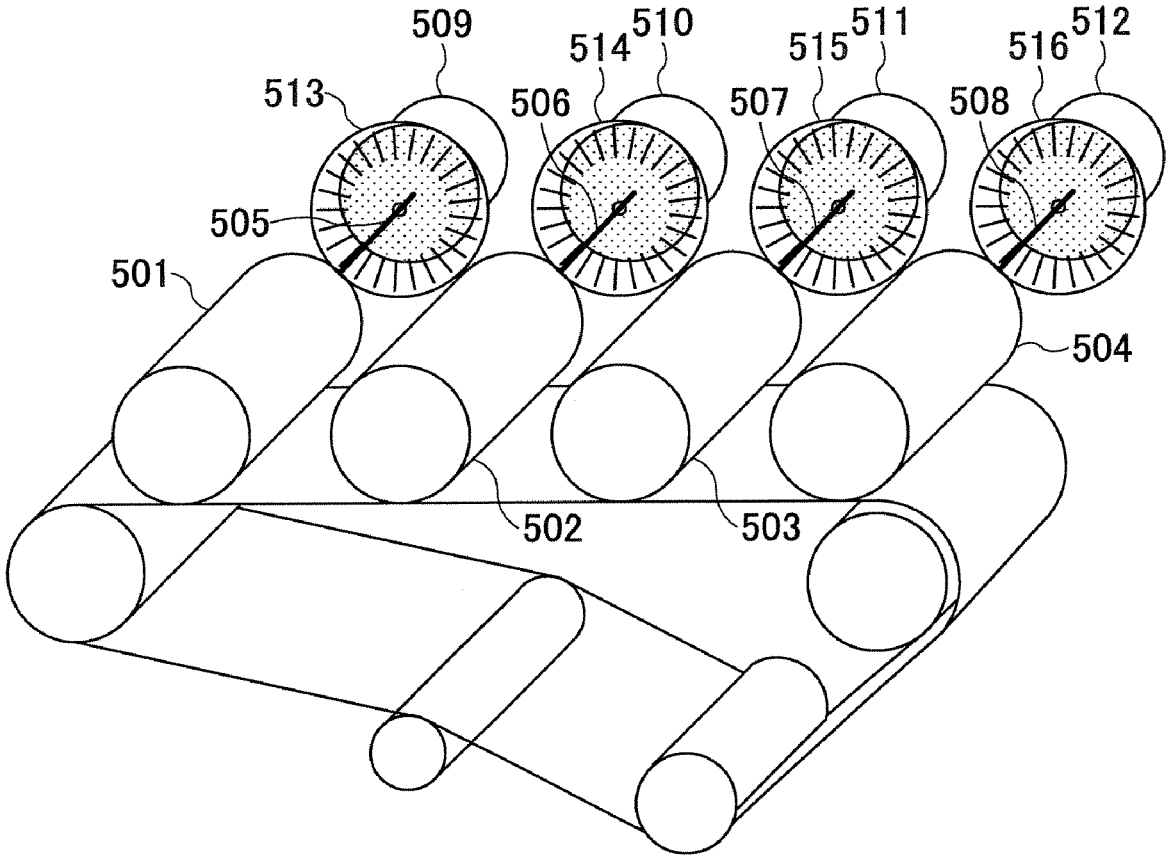
FIG. 4 is a diagram generally showing a driving mechanism for the photoconductive drums.

FIG. 4 is a diagram generally showing a driving mechanism for the photoconductive drums. As shown in FIG. 4, driving shafts 505 through 508 are provided to drive and rotate the photoconductive drums 402Y, 402M, 402C and 402K. In addition, brushless motors 509 through 512 are provided to drive and rotate the driving shafts 505 through 508 of the photoconductive drums 402Y, 402M, 402C and 402K. The rotational speeds of the brushless motors 509 through 512 are detected by corresponding encoders 513 through 516 that are provided on corresponding motor shafts of the brushless motors 509 through 512.

Figure 5:
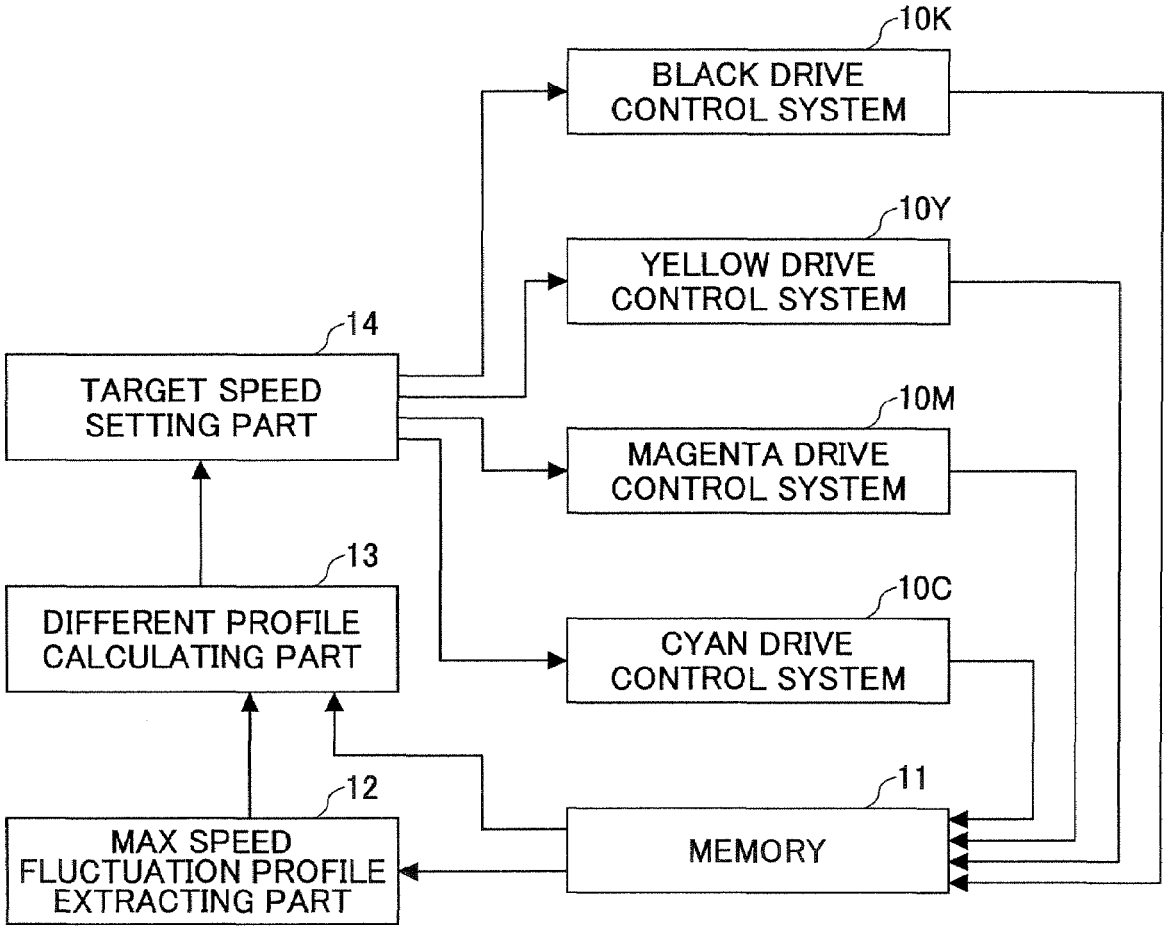
FIG. 5 is a system block diagram showing an embodiment of a drive control unit according to the present invention.

FIG. 5 is a system block diagram showing an embodiment of the drive control unit according to the present invention. The drive control unit shown in FIG. 5 includes a black drive control system 10K, a yellow drive control system 10Y, a magenta drive control system 10M, a cyan drive control system 10C, a memory 11, a maximum speed fluctuation profile extracting part 12, a difference profile calculating part 13, and a target speed setting part 14.

Figure 1:
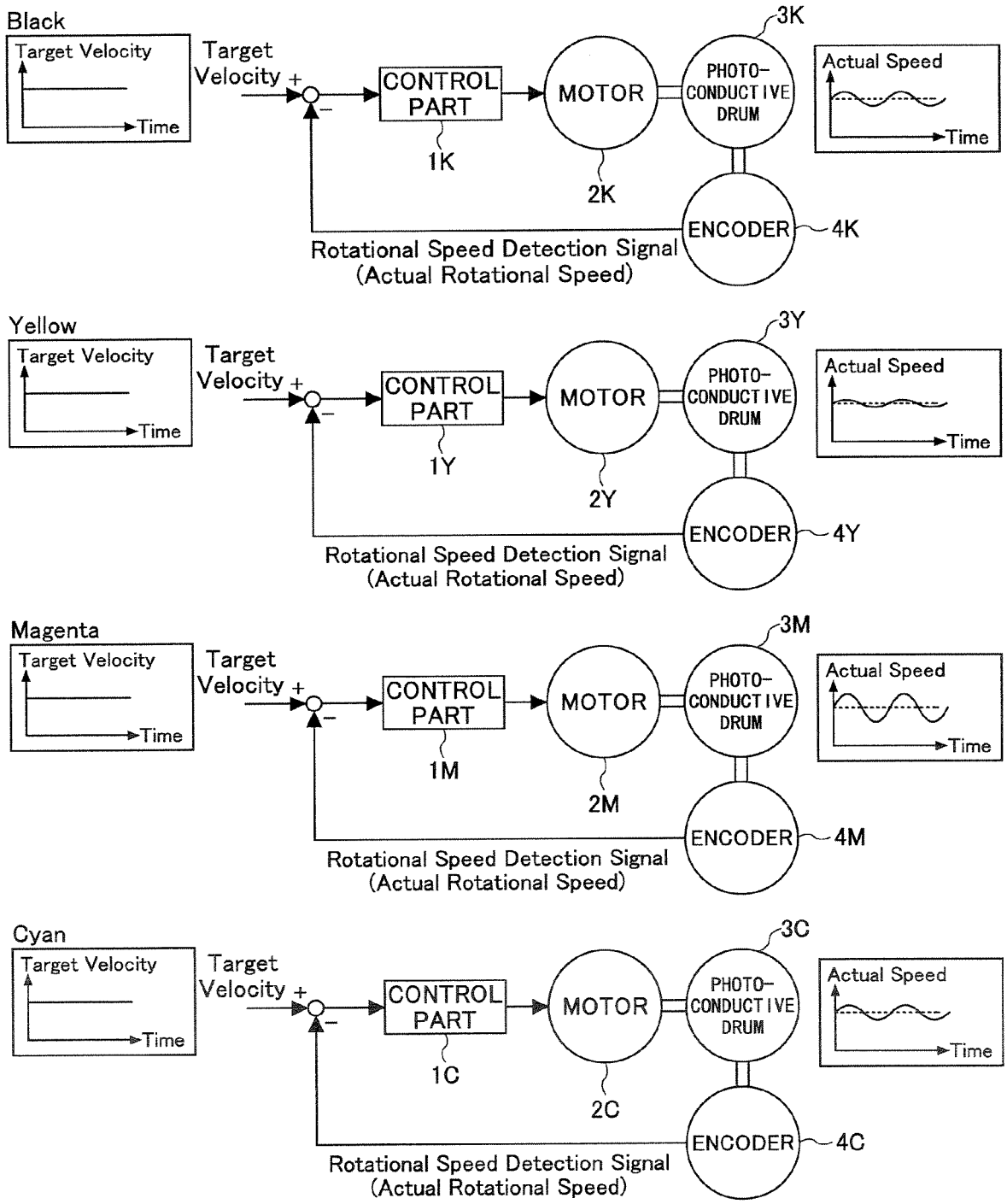
FIG. 1 is a system block diagram showing an example of a drive control unit for photoconductive drums.

The black drive control system 10K, the yellow drive control system 10Y, the magenta drive control system 10M and the cyan drive control system 10C have the structure shown in FIG. 1. The black drive control system 10K includes a control part 1K, a motor 2K, a photoconductive drum 3K and an encoder 4K. The yellow drive control system 10Y includes a control part 1Y, a motor 2Y, a photoconductive drum 3Y and an encoder 4Y. In addition, the magenta drive control system 10M includes a control part 1M, a motor 2M, a photoconductive drum 3M and an encoder 4M, and the cyan drive control system 10C includes a control part 1C, a motor 2C, a photoconductive drum 3C and an encoder 4C.

Figure 6:
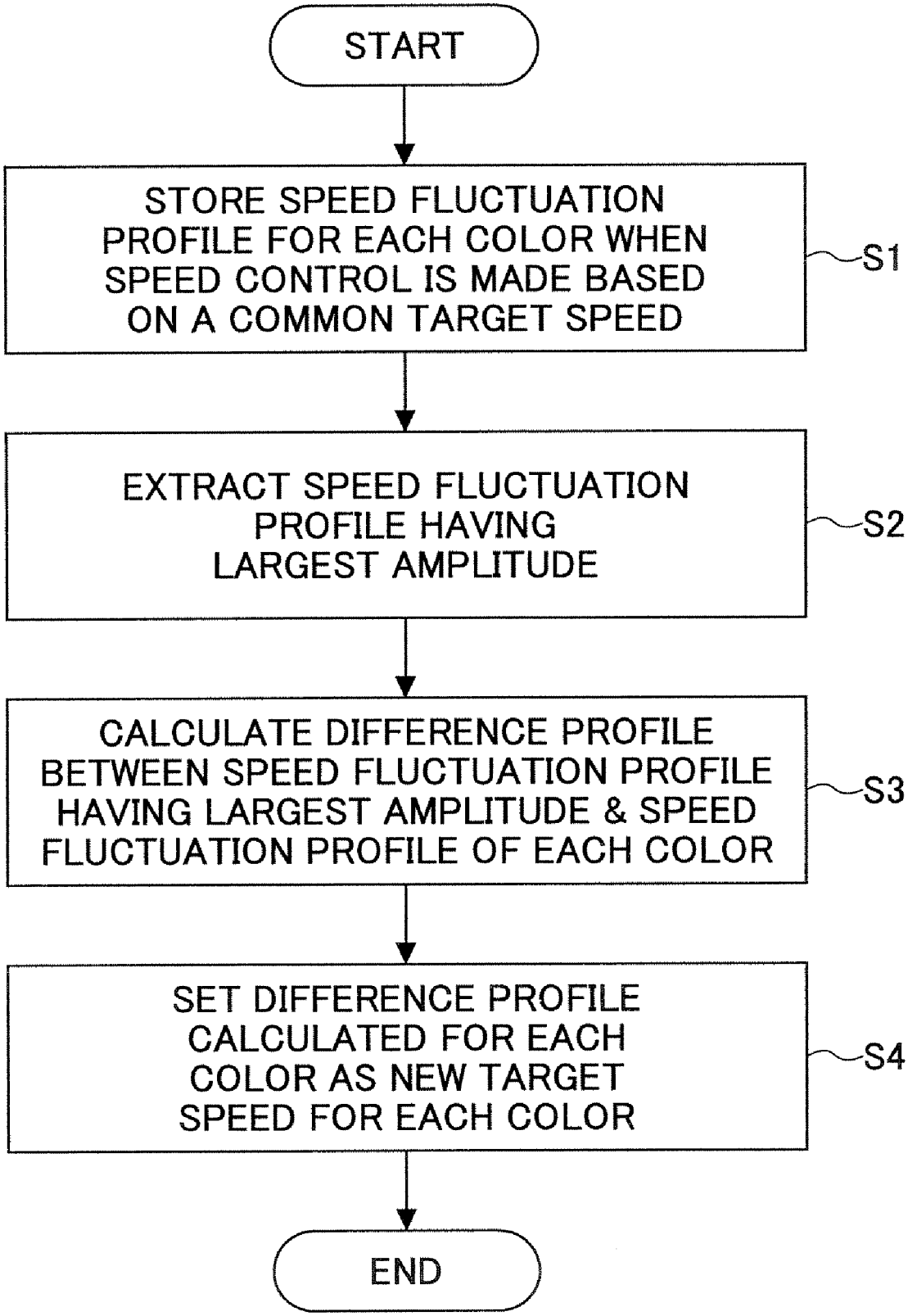
FIG. 6 is a flow chart for explaining an operation of the drive control unit.

Next, a description will be given of an operation of the drive control unit shown in FIG. 5, by referring to FIG. 6. FIG. 6 is a flow chart for explaining the operation of the drive control unit. In a step S1, the drive control unit stores in the memory 11 a speed fluctuation profile for each of the colors yellow, magenta, cyan and black for the case where the rotational speeds of the photoconductive drums 402Y, 402M, 402C and 402K are controlled based on a common target rotational speed which is set in common with respect to each of the photoconductive drums 402Y, 402M, 402C and 402K.

For example, the black drive control system 10K detects the actual rotational speed of the motor 2K for the case where the rotational speed of the motor 2K is controlled by the control part 1K based on the common target rotational speed which is a constant value, and stores the fluctuation in the rotational speed of the motor 2K for one revolution of the photoconductive drum 3K in the memory 11 as the speed fluctuation profile.

Similarly, the yellow drive control system 10Y detects the actual rotational speed of the motor 2Y for the case where the rotational speed of the motor 2Y is controlled by the control part 1Y based on the common target rotational speed which is a constant value, and stores the fluctuation in the rotational speed of the motor 2Y for one revolution of the photoconductive drum 3Y in the memory 11 as the speed fluctuation profile. The magenta drive control system 10M and the cyan drive control system 10C store the speed fluctuation profiles for the photoconductive drums 3M and 3Y in the memory 11, similarly to the black drive control system 10K and the yellow drive control system 10Y.

Figure 2:
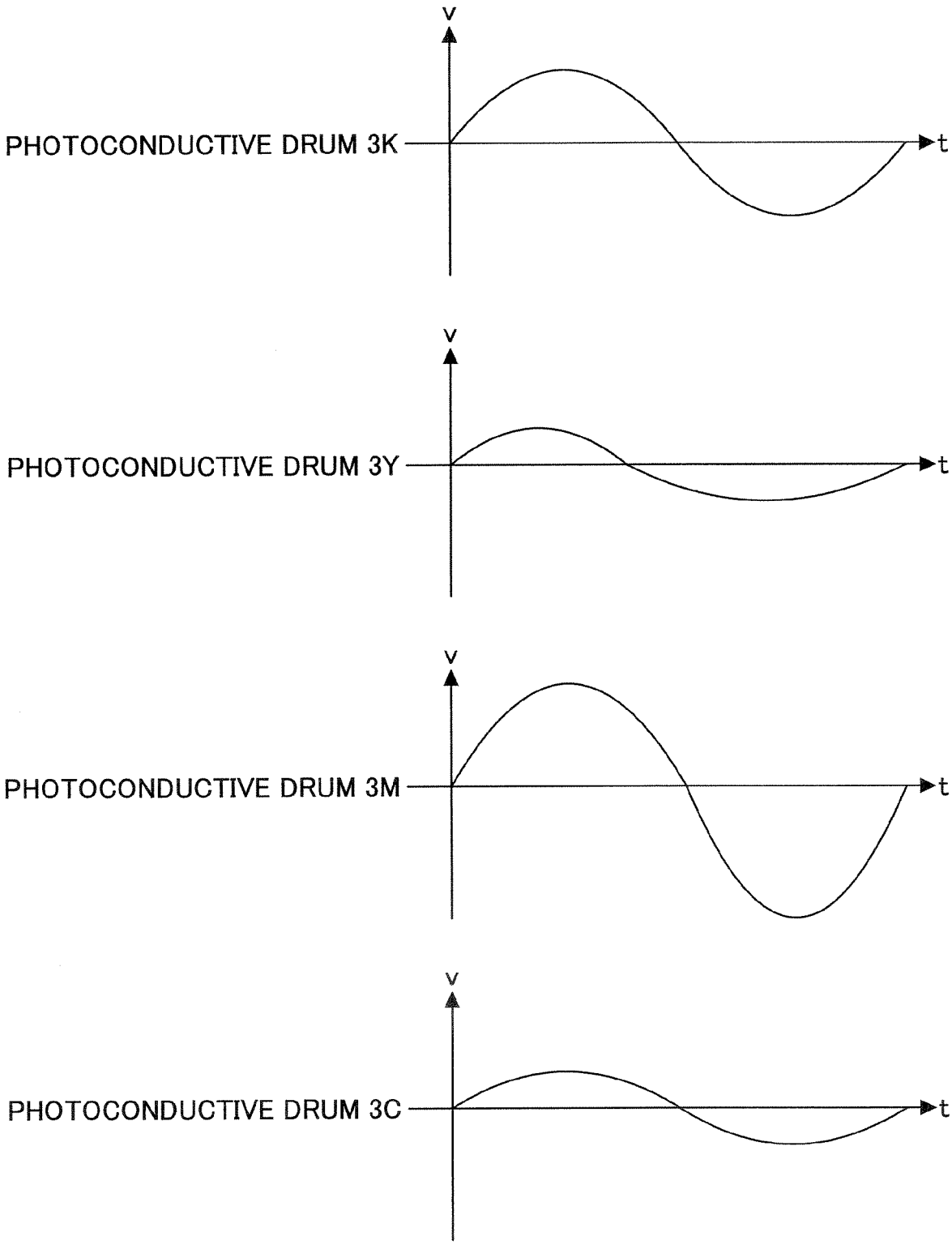
FIG. 2 is a graph showing actual speed fluctuations for one revolution of the photoconductive drums.

In a step S2, the maximum speed fluctuation profile extracting part 12 reads the speed fluctuation profiles of each of the yellow, magenta, cyan and black colors from the memory 11, and extracts the speed fluctuation profile having a largest amplitude. For example, in a case where the actual rotational speeds of the motors 2K, 2Y, 2M and 2C become as shown in FIG. 2 when the control parts 1K, 1Y, 2M and 1C control the rotational speeds of the motors 2K, 2Y, 2M and 2C based on the common target rotational speed which is a constant value, the speed fluctuation profile for magenta is extracted as the speed fluctuation profile having the largest amplitude. The maximum speed fluctuation profile extracting part 12 supplies the extracted speed fluctuation profile to the difference profile calculating part 13.

In a step S3, the difference profile calculating part 13 reads the speed fluctuation profiles of each of the colors yellow, magenta, cyan and black, and calculates a difference profile between the speed fluctuation profile having the largest amplitude and supplied from the maximum speed fluctuation profile extracting part 12 and each of the speed fluctuation profiles of the colors yellow, magenta, cyan and black.

For example, the difference profile calculating part 13 subtracts each of the speed fluctuation profiles of the colors yellow, magenta, cyan and black stored in the memory 11 from the speed fluctuation profile having the largest amplitude and supplied from the maximum speed fluctuation profile extracting part 12, so as to obtain the difference profiles for each of the colors yellow, magenta, cyan and black.

Figure 7:
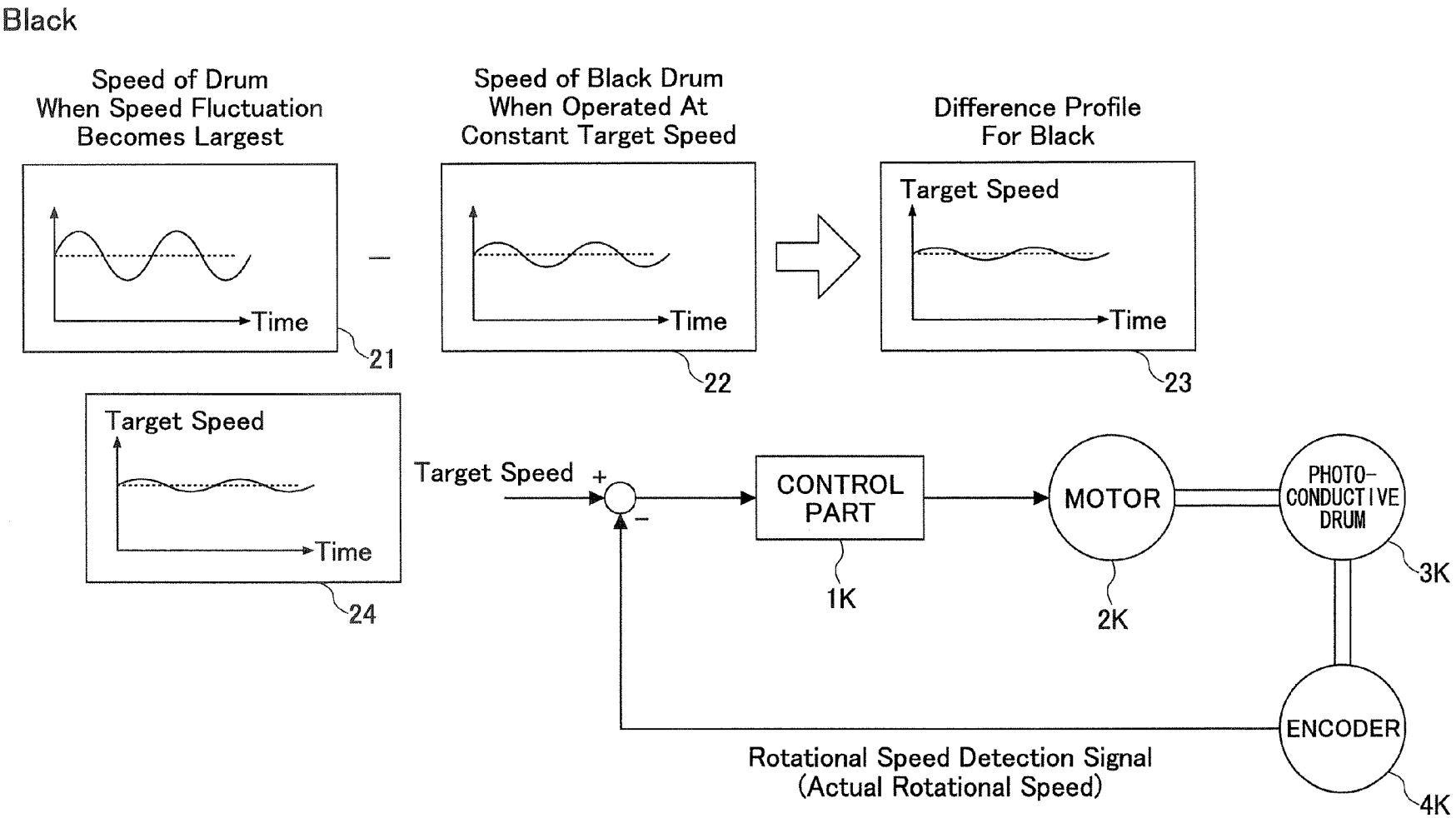
FIG. 7 is a diagram for explaining the calculation of a black difference profile and the setting of a new target rotational speed.
Figure 8:
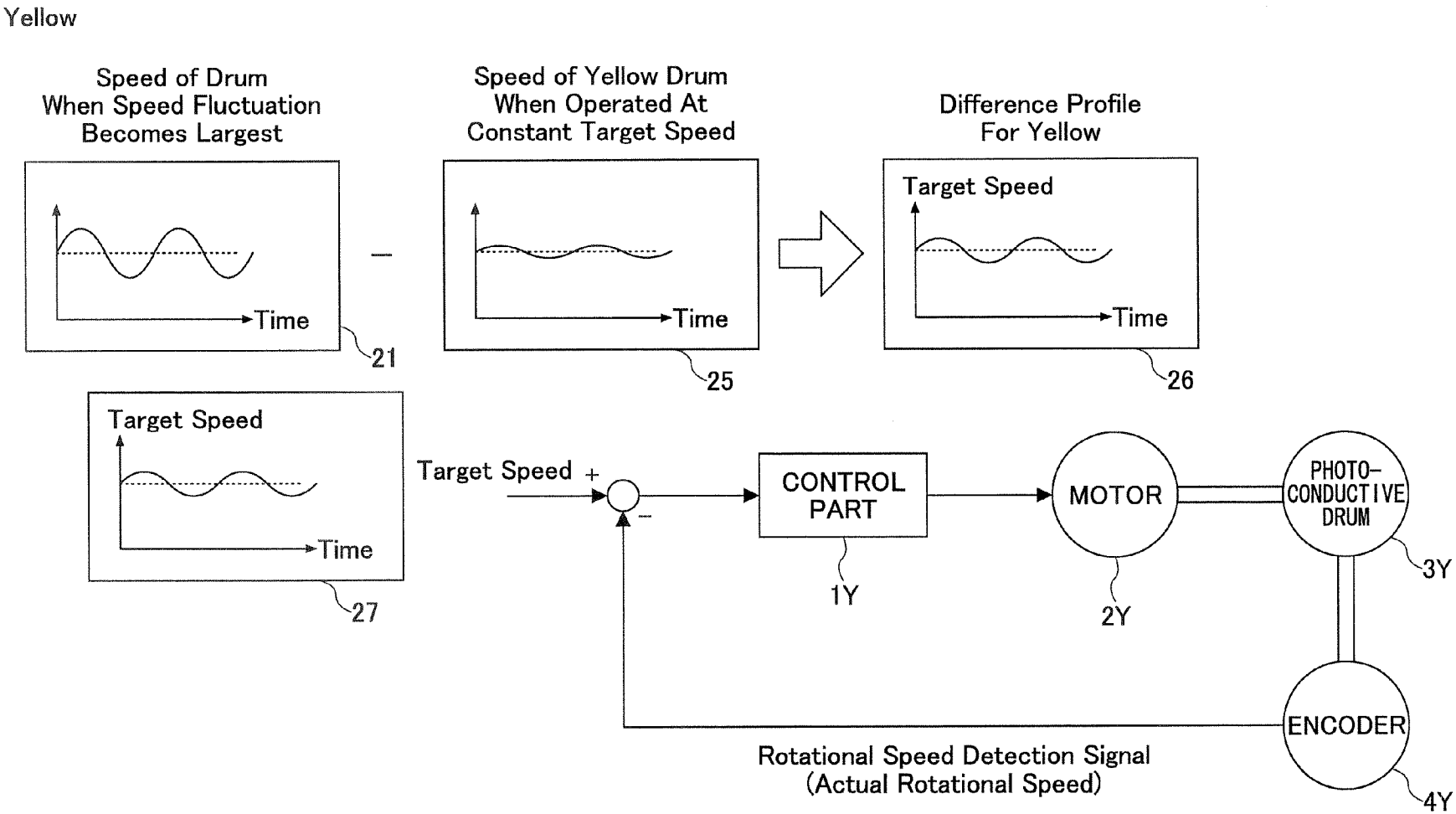
FIG. 8 is a diagram for explaining the calculation of a yellow difference profile and the setting of the new target rotational speed.
Figure 9:
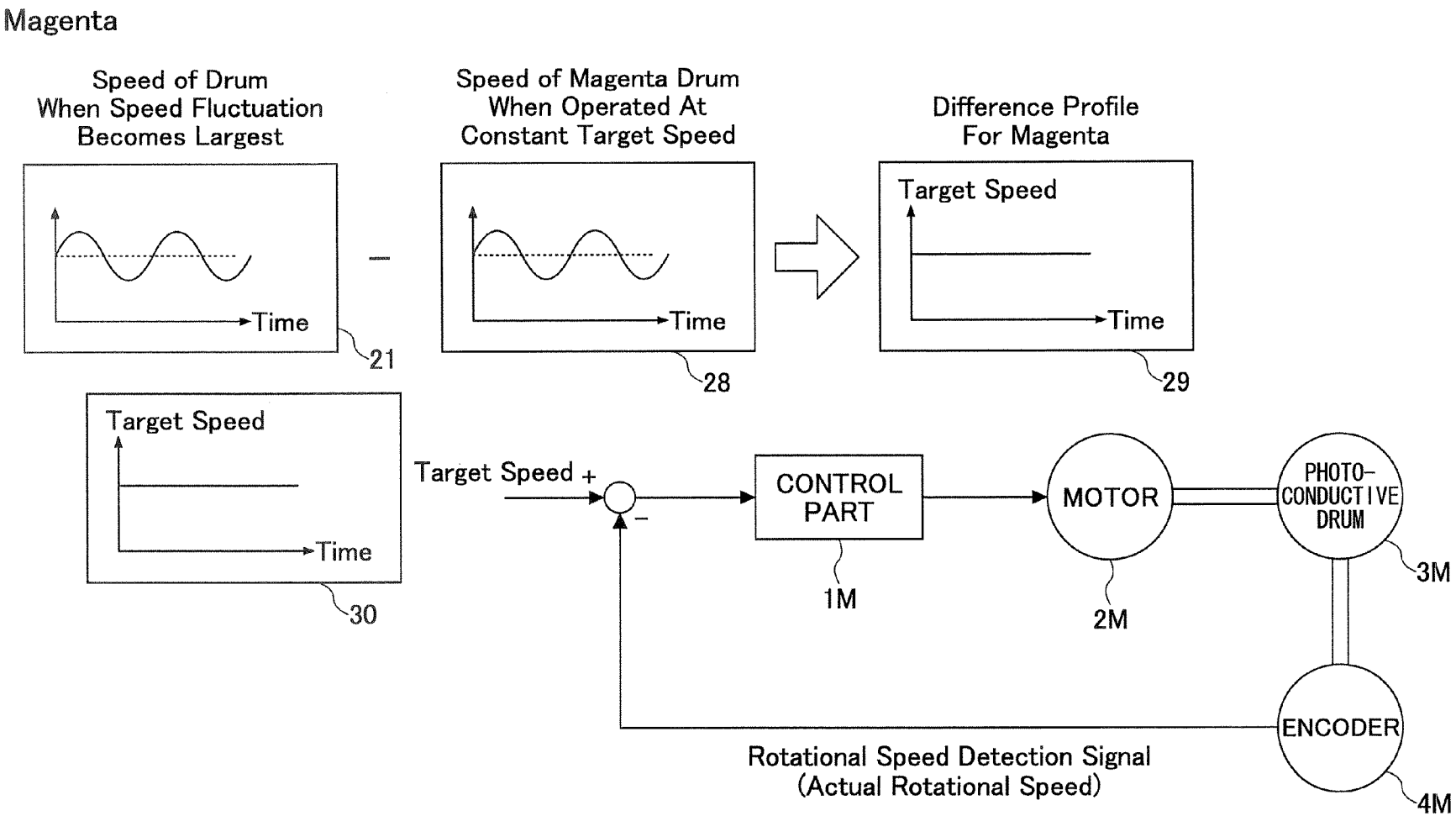
FIG. 9 is a diagram for explaining the calculation of a magenta difference profile and the setting of the new target rotational speed.
Figure 10:
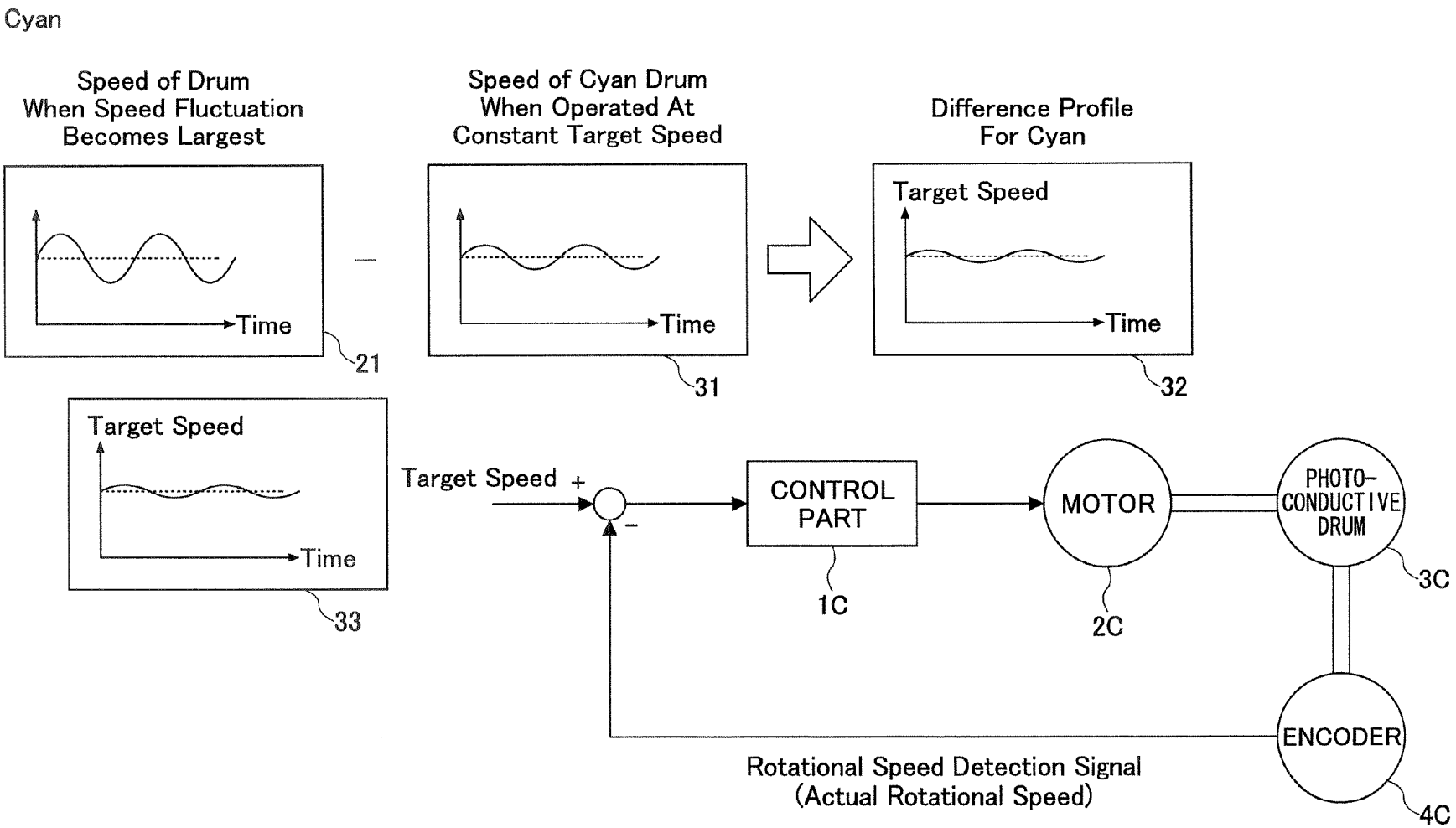
FIG. 10 is a diagram for explaining the calculation of a cyan difference profile and the setting of the new target rotational speed.

FIG. 7 is a diagram for explaining the calculation of a black difference profile and the setting of a new target rotational speed. FIG. 8 is a diagram for explaining the calculation of a yellow difference profile and the setting of the new target rotational speed. FIG. 9 is a diagram for explaining the calculation of a magenta difference profile and the setting of the new target rotational speed. FIG. 10 is a diagram for explaining the calculation of a cyan difference profile and the setting of the new target rotational speed.

FIGS. 7 through 10 show the calculation of the difference profiles and the setting of the new target rotational speed for the case where the speed fluctuation profile for magenta is extracted as the speed fluctuation profile having the largest amplitude. In FIG. 7, the difference profile calculating part 13 subtracts a speed fluctuation profile 22 for black stored in the memory 11 from an extracted speed fluctuation profile 21 for magenta, so as to calculate a difference profile 23 for black.

In FIG. 8, the difference profile calculating part 13 subtracts a speed fluctuation profile 25 for yellow stored in the memory 11 from the extracted speed fluctuation profile 21 for magenta, so as to calculate a difference profile 26 for yellow.

In FIG. 9, the difference profile calculating part 13 subtracts a speed fluctuation profile 28 for magenta stored in the memory 11 from the extracted speed fluctuation profile 21 for magenta, so as to calculate a difference profile 29 for magenta. In this particular case, the extracted speed fluctuation profile 21 and the subtracted speed fluctuation profile 28 are the same.

In FIG. 10, the difference profile calculating part 13 subtracts a speed fluctuation profile 31 for cyan stored in the memory 11 from the extracted speed fluctuation profile 21 for magenta, so as to calculate a difference profile 32 for cyan.

The difference profile calculating part 13 supplies the calculated difference profiles 23, 26, 29 and 32 for the colors black, yellow, magenta and cyan to the target speed setting part 14. Then, in a step S4 shown in FIG. 6, the target speed setting part 14 sets the difference profiles 23, 26, 29 and 32 for the colors black, yellow, magenta and cyan, supplied from the difference profile calculating part 13, as new target rotational speeds for the colors black, yellow, magenta and cyan.

In FIG. 7, the target speed setting part 14 sets the difference profile 23 for black as the new target rotational speed for the black drive control system 10K. In FIG. 8, the target speed setting part 14 sets the difference profile 26 for yellow as the new target rotational speed for the yellow drive control system 10Y. In FIG. 9, the target speed setting part 14 sets the difference profile 29 for magenta as the new target rotational speed for the magenta drive control system 10M. In FIG. 10, the target speed setting part 14 sets the difference profile 32 for cyan as the new target rotational speed for the cyan drive control system 10C.

In the case shown in FIGS. 7 through 10, the drive control unit sets the difference profiles 23, 26, 29 and 32 for the colors black, yellow, magenta and cyan as the new target rotational speeds for the black, yellow, magenta and cyan drive control systems 10K, 10Y, 10M and 10C, so as to include in the rotational speeds of the photoconductive drums 3K, 3Y and 3C for the colors other than magenta the same fluctuation in the rotational speed as the photoconductive drum 3M for magenta. As a result, the fluctuations in the rotational speeds of the photoconductive drums 3K, 3Y and 3C become larger when compared to the conventional case, but under a condition where the distance between two mutually adjacent photoconductive drums is equal to the circumference of the photoconductive drum and the moving speed of the transport belt (including the intermediate transfer belt in the case of the image forming apparatus having the intermediate transfer belt) is equal to the rotational speed at the outer periphery of the photoconductive drum, the relative speed of the photoconductive drum at the transfer position for each color becomes zero with respect to the transport belt. Therefore, the effects of the fluctuations in the rotational speeds of the photoconductive drums will not appear as the registration error in the full color image that is finally formed on the transfer member.

In order to carry out the control by the drive control unit of the present invention, it is necessary to once control the rotational speed of the photoconductive drums for each of the colors to the common target rotational speed which is a constant value. Such a control by the drive control unit may be carried out at timings including when the power is supplied to the image forming apparatus, when a paper jam is generated and the like. When the control is carried out by the drive control unit at such timings, the data related to the fluctuation in the rotational speed of each of the photoconductive drums may be stored in a recording medium such as the memory 11.

Figure 11:
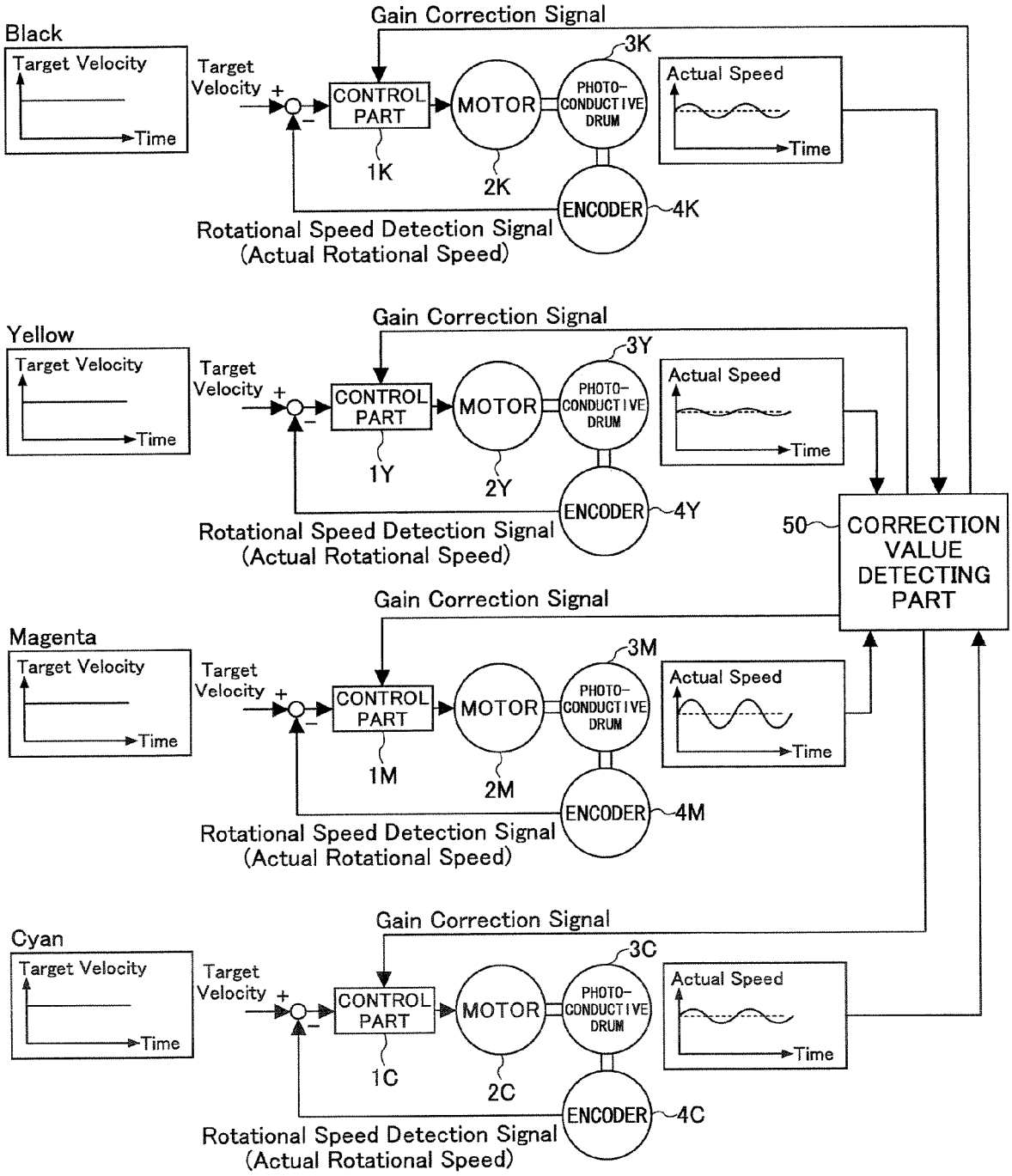
FIG. 11 is a system block diagram showing another embodiment of the drive control unit according to the present invention.

FIG. 11 is a system block diagram showing another embodiment of the drive control unit according to the present invention. In FIG. 11, those parts which are the same as those corresponding parts in FIGS. 7 through 10 are designated by the same reference numerals, and a description thereof will be omitted. In the drive control unit which compares the target rotational speed and the actual rotational speed output from the encoder based on a PLL (Phase Locked Loop) control or PID (Proportional Integral Differential) control, the means for matching the rotational speeds of the photoconductive drums of each of the colors to the rotational speed of the photoconductive drum having the largest fluctuation in the rotational speed may be realized by a gain correction of a correction value detecting part 50 for detecting correction values for the gains of the control parts 1K, 1Y, 1M and 1C.

According to the drive control unit of the present invention, the speed fluctuation profile of each photoconductive drum corresponding to the fluctuation in the rotational speed for one revolution of each photoconductive drum is detected. Of the detected speed fluctuation profiles, the speed fluctuation profile of the photoconductive drum having the largest fluctuation in the rotational speed is extracted, and the rotational speeds of the other photoconductive drums are controlled so as to match the extracted speed fluctuation profile. Hence, it is possible to eliminate, in a relative manner and using a relatively simply structure, the speed fluctuation components among the plurality of photoconductive drums. As a result, the drive control unit of the present invention can match the rotational speeds of the plurality of photoconductive drums, and reduce the registration error of the full color image that is finally formed on the transfer member by the plurality of photoconductive drums.

In addition, according to the drive control unit of the present invention, if the image forming apparatus is used for a long period of time and the constituent elements of the image forming apparatus deteriorate due to aging, the speed fluctuation profiles of the photoconductive drums are matched to the speed fluctuation profile of the photoconductive drum having the largest speed fluctuation. For this reason, the registration error will not be generated even if the so-called banding occurs. The banding refers to a band-shaped tone inconsistency that appears in a halftone portion of the image. The banding occurs when the pitch of the halftone dots changes due to the fluctuation in the speed of the mechanical system, for example, and often occurs in the case of the image forming apparatus employing the spot exposure scan system.

This application claims the benefit of a Japanese Patent Application No. 2005-248009 filed Aug. 29, 2005, in the Japanese Patent Office, the disclosure of which is hereby incorporated by reference.

Further, the present invention is not limited to these embodiments, but various variations and modifications may be made without departing from the scope of the present invention.

What is claimed is:

1. A drive control unit for controlling speeds of a plurality of motors based on a target speed, comprising:

a detecting part configured to detect speed fluctuations of each of the motors when the speeds of the motors are controlled based on a common target speed;

a storage part configured to store speed fluctuation profiles of each of the motors created based on the detected speed fluctuations for each of the motors;

an extracting part configured to extract a speed fluctuation profile of a motor having a speed fluctuation profile with a largest amplitude of the speed fluctuation profiles for each of the motors stored in the storage part;

a calculating part configured to calculate a difference profile between the extracted speed fluctuation profile and a speed fluctuation profile of a motor which is a speed control target and is different from the motor having the extracted speed fluctuation profile;

a setting part configured to set the calculated difference profile as a new target speed for the motor which is the speed control target; and a control part configured to control the speed of the motor which is the speed control target based on the new target speed.

2. The drive control unit as claimed in claim 1, wherein the motors are coupled to corresponding photoconductive drums so as to independently control rotational speeds of the corresponding photoconductive drums.

3. The drive control unit as claimed in claim 2, wherein the speed fluctuation profiles correspond to the speed fluctuations of the motors for one revolution of the corresponding photoconductive drums.

4. The drive control unit as claimed in claim 1, wherein the calculating part calculates the difference profiles by subtracting the speed fluctuation profiles of each of the motors from the extracted speed fluctuation profile.

5. A drive control method for controlling speeds of a plurality of motors of an image forming apparatus based on a target speed, comprising:

detecting speed fluctuations of each of the motors when the speeds of the motors are controlled based on a common target speed;

extracting a speed fluctuation profile of a motor having a speed fluctuation profile with a largest amplitude from speed fluctuation profiles for each of the motors created based on the detected speed fluctuations;

calculating a difference profile between the extracted speed fluctuation profile and a speed fluctuation profile of a motor which is a speed control target and is different from the motor having the extracted speed fluctuation profile; and utilizing the calculated difference profile as a new target speed for the motor which is the speed control target and controlling the speed of the motor which is the speed control target based on the new target speed.

6. The drive control method as claimed in claim 5, wherein the motors are coupled to corresponding photoconductive drums so as to independently control rotational speeds of the corresponding photoconductive drums.

7. The drive control method as claimed in claim 6, wherein the speed fluctuation profiles correspond to the speed fluctuations of the motors for one revolution of the corresponding photoconductive drums.

8. The drive control method as claimed in claim 5, wherein said calculating the difference profiles calculates the difference profiles by subtracting the speed fluctuation profiles of each of the motors from the extracted speed fluctuation profile.

9. An image forming apparatus which forms toner images on a plurality of photoconductive drums and directly or indirectly transfers the toner images onto a recording medium to form a full color image thereon, comprising:

a plurality of motors configured to independently control rotational speeds of corresponding photoconductive drums; and a drive control unit configured to control speeds of the plurality of motors based on a target speed, said drive control unit comprising:

a detecting part configured to detect speed fluctuations of each of the motors when the speeds of the motors are controlled based on a common target speed;

a storage part configured to store speed fluctuation profiles of each of the motors created based on the detected speed fluctuations for each of the motors;

an extracting part configured to extract a speed fluctuation profile of a motor having a speed fluctuation profile with a largest amplitude of the speed fluctuation profiles for each of the motors stored in the storage part;

a calculating part configured to calculate a difference profile between the extracted speed fluctuation profile and a speed fluctuation profile of a motor which is a speed control target and is different from the motor having the extracted speed fluctuation profile;

a setting part configured to set the calculated difference profile as a new target speed for the motor which is the speed control target; and a control part configured to control the speed of the motor which is the speed control target based on the new target speed.

10. The image forming apparatus as claimed in claim 9, wherein the speed fluctuation profiles correspond to the speed fluctuations of the motors for one revolution of the corresponding photoconductive drums.

11. The image forming apparatus as claimed in claim 9, wherein the calculating part of the drive control unit calculates the difference profiles by subtracting the speed fluctuation profiles of each of the motors from the extracted speed fluctuation profile.

* * * * *